US009970595B2

(12) United States Patent
Modirzareh et al.

(10) Patent No.: US 9,970,595 B2
(45) Date of Patent: May 15, 2018

(54) BREATHING APPARATUS FILLING STATION AND FILLING STATION RECHARGING DEVICE

(75) Inventors: Amir Modirzareh, Mt Waverly (AU); Maximilian Stefan Theodor Reiling, Coburg (AU)

(73) Assignee: Dräger Safety AG & Co. KGaA, Lübeck (DE)

( * ) Notice: Subject to any disclaimer, the term of this patent is extended or adjusted under 35 U.S.C. 154(b) by 465 days.

(21) Appl. No.: 14/382,160

(22) PCT Filed: Jun. 21, 2012

(86) PCT No.: PCT/AU2012/000722
§ 371 (c)(1),
(2), (4) Date: Aug. 29, 2014

(87) PCT Pub. No.: WO2013/126943
PCT Pub. Date: Sep. 6, 2013

(65) Prior Publication Data

US 2015/0204484 A1 Jul. 23, 2015

(30) Foreign Application Priority Data

Mar. 1, 2012 (AU) ..... 2012201265

(51) Int. Cl.
*B65B 37/00* (2006.01)
*F17C 5/06* (2006.01)
(Continued)

(52) U.S. Cl.
CPC ..... *F17C 5/06* (2013.01); *A62B 7/02* (2013.01); *A62B 7/10* (2013.01); *A62B 9/02* (2013.01);
(Continued)

(58) Field of Classification Search
CPC .... F17C 5/06; F17C 13/084; F17C 2270/025; F17C 2201/058; F17C 2205/0394
See application file for complete search history.

(56) References Cited

U.S. PATENT DOCUMENTS 5,404,921 A 4/1995 Lamoreaux et al.
5,673,735 A 10/1997 Crvelin et al.
(Continued)

OTHER PUBLICATIONS

Canadian Search Report of Oct. 19, 2015.

*Primary Examiner* — Jason K Niesz
(74) *Attorney, Agent, or Firm* — McGlew and Tuttle, P.C.

(57) ABSTRACT

A filling station for a breathing apparatus includes a cradle that houses a fill panel, a manifold and a cascade bank system. The fill panel has one or more sequence valves for controlling filling of one or more compressed air breathing apparatus with air stored in the cascade bank system. The manifold connects the fill panel to the cascade bank system. The cascade bank system has a cylinder store including five or more banks. Also provided is a filling station recharging device that has a cradle, a manifold, a cylinder store and a pump. The control panel has one or more valves for controlling recharging of one or more breathing apparatus filling station with air stored in the cylinder store. The manifold connects the control panel and pump to the cylinder store. The pump and cylinder store at least partially power the recharging.

18 Claims, 11 Drawing Sheets

(51) Int. Cl.

| | |
|---|---|
| ***A62B 7/02*** | (2006.01) |
| ***A62B 7/10*** | (2006.01) |
| ***A62B 9/02*** | (2006.01) |
| ***F17C 13/08*** | (2006.01) |

(52) U.S. Cl.
CPC .... *F17C 13/084* (2013.01); *F17C 2201/0104* (2013.01); *F17C 2201/058* (2013.01); *F17C 2205/0394* (2013.01); *F17C 2221/031* (2013.01); *F17C 2270/025* (2013.01); *F17C 2270/079* (2013.01); *F17C 2270/0745* (2013.01)

(56) References Cited

U.S. PATENT DOCUMENTS

| | | | | |
|---|---|---|---|---|
| 7,415,995 | B2 | 8/2008 | Plummer et al. | |
| 2008/0271796 | A1* | 11/2008 | Neumann ..... | F17C 5/06 137/606 |
| 2010/0089489 | A1 | 4/2010 | Turiello | |

* cited by examiner

BREATHING APPARATUS FILLING STATION AND FILLING STATION RECHARGING DEVICE

CROSS REFERENCE TO RELATED APPLICATIONS

This application is a United States National Phase Application of International Application PCT/AU2012/000722 filed Jun. 21, 2012 and claims the benefit of priority under 35 U.S.C. § 119 of Australia Patent Application 2012201265 filed Mar. 1, 2012, the entire contents of which are incorporated herein by reference.

FIELD OF THE INVENTION

The invention described herein relates generally to a filling station for a breathing apparatus and a recharging device for the filling station. In particular, the invention is directed to a filling station for filling a breathing apparatus comprising five or more banks and a filling station recharging device powered by compressed air, although the scope of the invention is not necessarily limited thereto.

BACKGROUND OF THE INVENTION

Breathing apparatus (BA) are used routinely in environments where there is no breathable air and in emergency situations when the availability or quality of air is not guaranteed. For example, in underground mines in an emergency situation workers are required to put on a BA as part of the emergency protocol.

Filling stations are required to refill the BAs so that they are ready for use and in situations where the BA is in use and must be refilled. Filling stations ordinarily fill BAs with compressed air (CA); giving rise to the term CABA (Compressed Air Breathing Apparatus). Improved filling stations are required for increased safety.

Safety concerns also require reliable and efficient recharging devices for refilling such filling stations. Accordingly, improved recharging devices are also required.

SUMMARY OF THE INVENTION

The present invention is broadly directed to a filling station for a breathing apparatus and filling station recharging device. A preferred advantage of the filling station is that it can fill more CABAs without recharging than comparable filling stations. Another preferred advantage is that filling of CABAs by the invention is quicker than comparable filling stations.

In one aspect, there is provided a filling station for a breathing apparatus comprising:

- a cradle comprising a fill panel, a manifold and a cascade bank system;
- the fill panel comprising one or more sequence valves for controlling filling of one or more compressed air breathing apparatus with air stored in the cascade bank system;
- the manifold connecting the fill panel to the cascade bank system; and
- the cascade bank system comprising a cylinder store comprising five or more banks.

In a preferred embodiment of the first aspect, the cylinder store comprises five banks.

In one embodiment of the first aspect, the fill panel may comprise four sequence valves controlling the five or more banks.

In one embodiment of the first aspect, one or more of the sequence valves may comprise a lock to secure the sequence valve.

In one embodiment of the first aspect, one or more of the sequence valves may comprise a locknut to secure the sequence valve.

In a preferred embodiment of the first aspect, the five or more banks may comprise a first bank comprising six cylinders, a second bank comprising four cylinders, a third bank comprising four cylinders, a fourth bank comprising three cylinders and a fifth bank comprising three cylinders.

In other embodiments of the first aspect, the five or more banks may comprise a configuration selected from the following:

| Number of cylinders | | | | |
|---|---|---|---|---|
| First Bank | Second Bank | Third Bank | Fourth Bank | Fifth Bank |
| 6 | 4 | 4 | 3 | 3 |
| 5 | 4 | 4 | 4 | 3 |
| 5 | 4 | 5 | 3 | 3 |
| 5 | 5 | 3 | 4 | 3 |
| 5 | 5 | 4 | 3 | 3 |
| 5 | 5 | 4 | 4 | 2 |
| 4 | 4 | 4 | 4 | 4 |
| 4 | 4 | 5 | 4 | 3 |
| 4 | 5 | 4 | 4 | 3 |
| 4 | 5 | 5 | 3 | 3 |
| 7 | 3 | 4 | 3 | 3 |
| 7 | 4 | 3 | 3 | 3 |
| 7 | 4 | 3 | 4 | 2 |
| 7 | 4 | 4 | 3 | 2 |
| 6 | 3 | 3 | 4 | 4 |
| 6 | 3 | 4 | 3 | 4 |
| 6 | 3 | 4 | 4 | 3 |
| 6 | 3 | 5 | 3 | 3 |
| 6 | 3 | 5 | 4 | 2 |
| 6 | 4 | 3 | 3 | 4 |
| 6 | 4 | 3 | 4 | 3 |
| 6 | 4 | 3 | 5 | 2 |
| 6 | 4 | 4 | 4 | 2 |
| 6 | 4 | 5 | 2 | 3 |
| 6 | 4 | 5 | 3 | 2 |
| 6 | 5 | 3 | 3 | 3 |
| 6 | 5 | 3 | 4 | 2 |
| 6 | 5 | 4 | 2 | 3 |
| 6 | 5 | 4 | 3 | 2 |
| 6 | 6 | 3 | 3 | 2 |

In one embodiment of the first aspect, the manifold may further comprise a recharging connection for connecting the filling station to a compressor or other recharging device to allow recharging of the cylinder store.

In one embodiment of the first aspect, the filling station and/or the filling station recharging device do not comprise any electronic component.

In a second aspect, the invention provides a method for filling a compressed air breathing apparatus using the device of the first aspect.

In a third aspect, the invention provides a method of filling a compressed air breathing apparatus including connecting the compressed air breathing apparatus to a filling station wherein the filling station comprises a cascade bank system comprising a cylinder store comprising five or more banks.

In one embodiment of the third aspect, the method further includes using one or more sequence valves to control the sequence of filling from the cascade bank system.

In one embodiment of the second or third aspect, one or more CABA is filled simultaneously.

In a preferred embodiment of the second aspect, the cylinder store comprises five banks.

In one embodiment of the third aspect, the method may include using four sequence valves controlling the five or more banks.

In one embodiment of the third aspect, the method may further include using one or more lock to secure the one or more sequence valves or respective sequence valve of the four sequence valves.

In one embodiment of the third aspect, the method may further include using one or more locknut to secure the one or more sequence valves or respective sequence valve of the four sequence valves.

In a fourth aspect, the invention provides a filling station recharging device comprising:

- a cradle comprising a control panel, a manifold, a cylinder store and a Pump;
- the control panel comprising one or more valves for controlling recharging of one or more breathing apparatus filling station with air stored in the cylinder store;
- the manifold connecting the control panel and pump to the cylinder store; and
- the pump and cylinder store at least partially powering the recharging.

In one embodiment of the fourth aspect, the filling station recharging device does not comprise any electronic component.

In a fifth aspect, the invention comprises a method of recharging a breathing apparatus filling station using the device of the fourth aspect.

In one embodiment of the fifth aspect, the filling station may be the filling station of the first aspect.

In a sixth aspect, the invention provides a method of recharging a breathing apparatus filling station including the step of connecting a recharging device comprising a cylinder store and a pump to the filling station and recharging the filling station with compressed air comprised in the cylinder store powered at least in part by the pump.

In a seventh aspect, the invention provides a filling station assembly comprising the filling station of the first aspect and the filling station recharging device of the fourth aspect.

In an eighth aspect, the invention provides a compressed air breathing apparatus (CABA) filled by the filling station of the first aspect, the method of the second aspect or the method of the third aspect or the assembly of the seventh aspect.

In a ninth aspect, the invention provides a filling station recharged with the recharging device of the first aspect, the method of the fifth aspect or the method of the sixth aspect.

The invention also provides a filling station, a method of filling a breathing apparatus, a recharging device, a method of recharging a filling station, a fill station assembly, a refilled breathing apparatus and a recharged filling station substantially as herein described with or without reference to the figures and/or examples.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Surprisingly, the inventors have produced a filling station that allows filling of an increased number of CABAs and does so in a shorter period of time than possible with conventional filling stations. Also of surprise, is the inventor's contribution of a filling station recharging device that uses a pump and compressed air to power the recharging. The contribution by the present inventors is of significant advantage because it has significantly increased safety implications in the often hazardous environments where CABAs are used.

The skilled person will understand that "filling", "refilling" and "charging" and "recharging" mean filling or refilling of an air storage. This air storage may be air stored in a CABA, filling station or recharging device. Although these four terms may be used interchangeably, for ease of reference, "filling" and "refilling" will be used with reference to filling a CABA with a filling station and "charging" and "recharging" will be used with reference to filling a filling station from a compressor; filling a filling station from a recharging device; and filling a recharging device from a compressor.

Figure 1A:
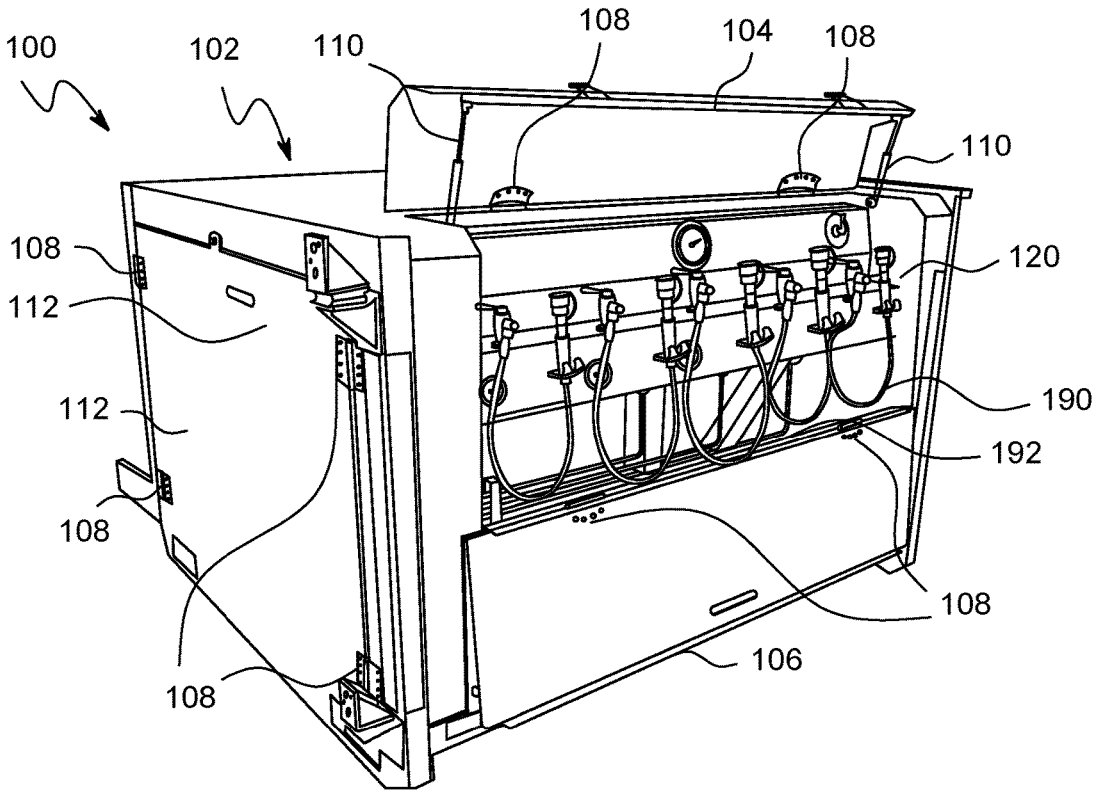
FIG. 1A is a perspective view showing one embodiment of the filling station of the invention.

FIG. 1A shows one embodiment of the filling station 100 of the invention. The cradle 102 of the filling station 100 comprises a top hatch 104, bottom hatch 106 and side doors 112 which open by swinging on hinges 108. Support struts 110 hold top hatch 104 up.

Cradle 102 fully encloses filling station 100 and is in the form of a cradle that has retaining brackets that enables forklift access from three or four sides. High visibility indicators may be comprised on cradle 102 such as, bright paint and/or reflective decals. Cradle 102 may comprise a quick detachment system (QDS).

Suitably the cradle 102 is comprised of Mild Steel. However, other strong metals or other strong materials may be suitable. Based on the teachings herein a skilled person is readily able to select suitable materials for cradle 102.

In the embodiment shown, cradle 102 has dimensions of 2000 mm Long×1670 mm Wide×1350 mm High. The dimensions may be varied to house the various components of filling station 100.

Figure 6:
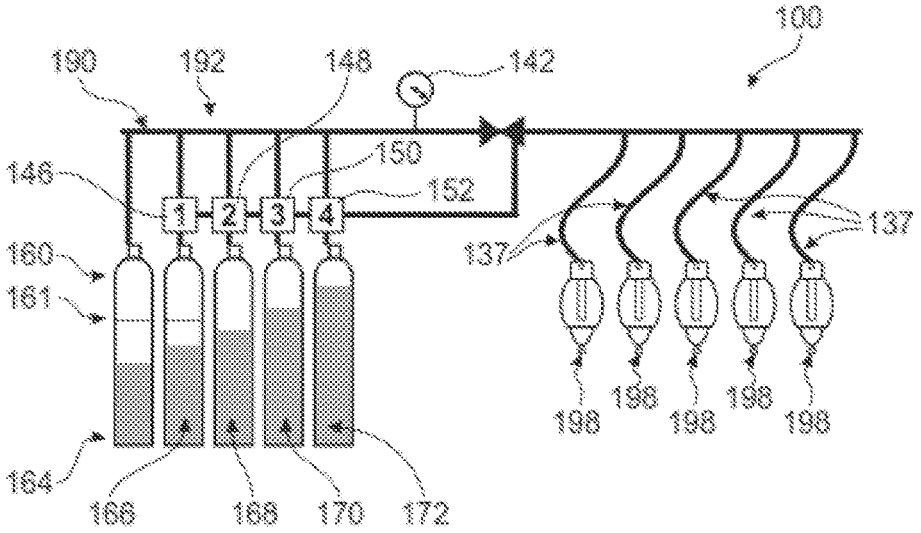
FIG. 6 is a schematic diagram showing one embodiment of the cascade bank system of the invention.

With the top and bottom hatches 104, 106 open, as shown in FIG. 1A, the fill panel 120 is visible. Fill panel 120 controls the air flow to ensure safe and quick recharging of one or more CABA 198 (FIG. 6). As will be described below, the logic of fill panel 120 makes possible the most effective use of the stored air pressure to maximize the number of CABA fills.

Also visible is manifold 190 which comprises pipe 192 which connects various components of filling station 100. Manifold 190 comprises a network of pipe 192 and connectors which will be described below. In the embodiment shown, manifold 190 comprises stainless steel and ⅜" and ¼" tubes and connectors are used. In another embodiment, manifold 190 may comprise coated mild steel and or flexible hose. The flexible hose may be used at the outlet of fill panel 120 to connect the fill panel 120 to the CABA 198.

Figure 1B:
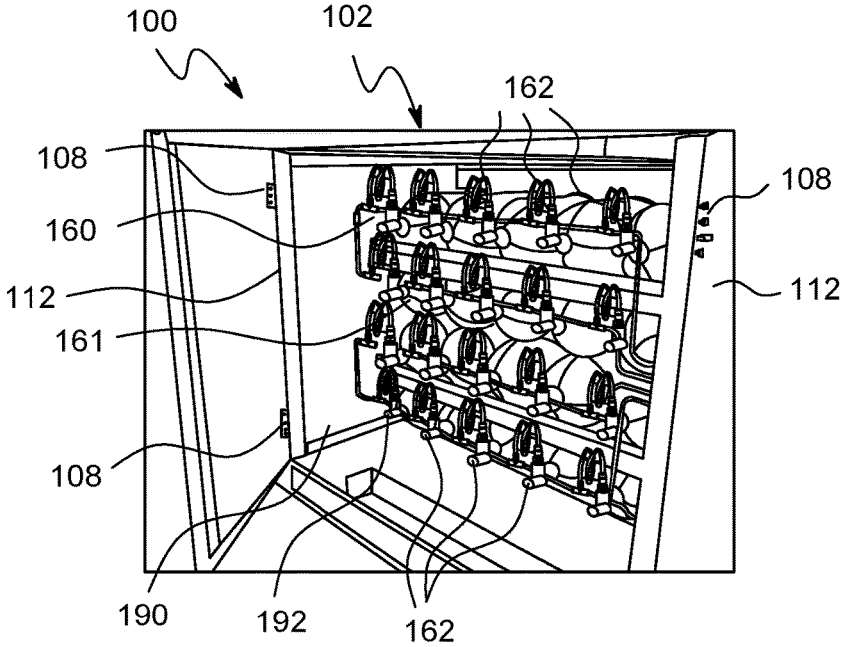
FIG. 1B is a perspective view showing the embodiment of FIG. 1A with the side door open.

Turning to FIG. 1B, which shows side doors 112 open, it can be seen that pipe 192 connects fill panel 120 to a cascade bank system 160 which comprises a cylinder store 161. As will be described in more detail, below the cylinder store 161 comprises twenty cylinders 162 separated into five banks 164-172 comprising: bank 1, 164; bank 2, 166; bank 3, 168; bank 4, 170; and bank 5, 172.

Surprisingly, the inventors have discovered that increased efficiency and an increased number of fills may be achieved by dividing the cascade bank 160 system into five banks.

Figure 2:
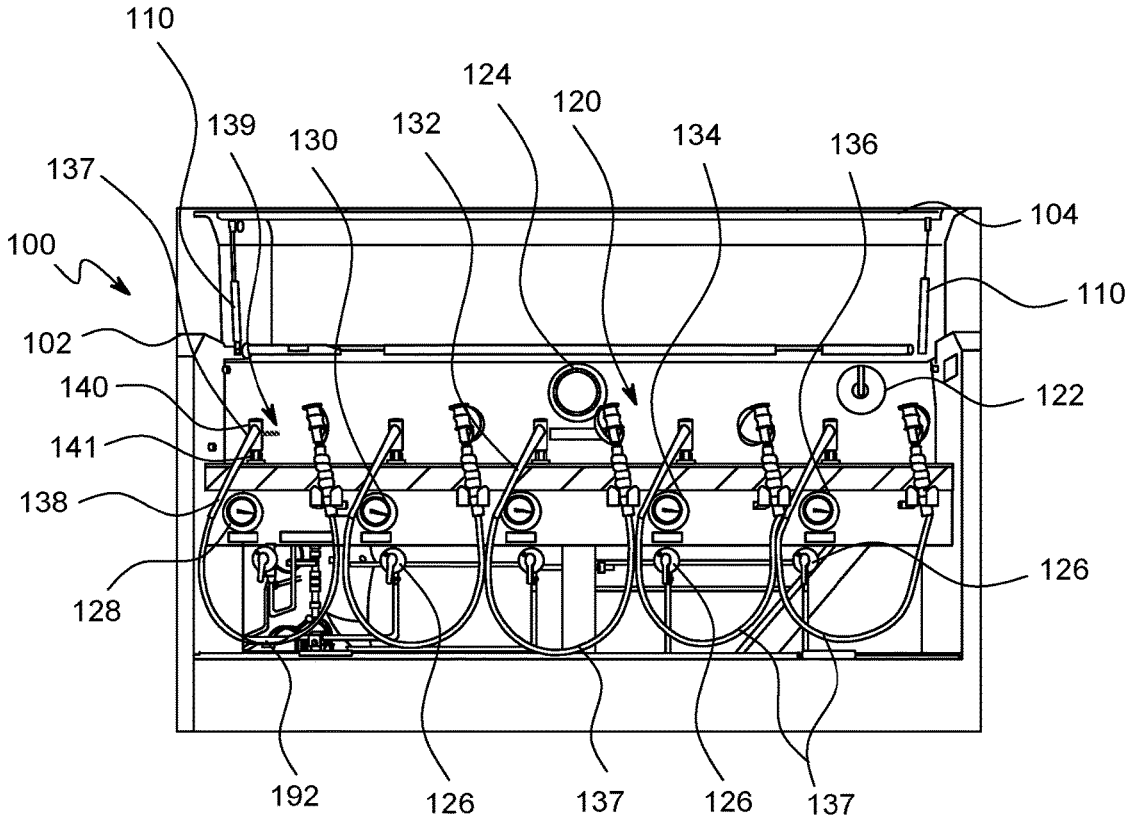
FIG. 2 is a front view showing one embodiment of the fill panel according to the invention.
Figure 3:
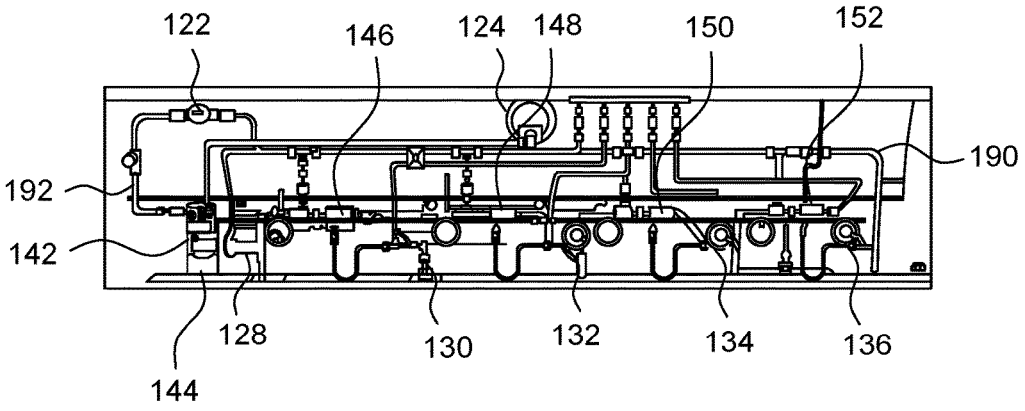
FIG. 3 is a rear view of a fill panel according to one embodiment of the invention.

FIGS. 2 and 3 show fill panel 120 in more detail and illustrate sequence valves 146, 148, 150, 152, which control the switching between banks 1 to 5 164, 166, 168, 170, 172 in order to achieve the quickest, most efficient and greatest number of CABA fills. The switching may be automatic. Fill panel 120 comprises main shut off valve 122 and fill pressure indication gauge 124. Main shut off valve 122 comprises a ball valve manufactured by Prochem. Based on the teaching herein, a skilled person is readily able to select other suitable valves such as those manufactured by Swagelok. Main shut off valve 122 can be turned to either "ON" or "OFF" to activate and deactivate filling station 100.

In use the fill pressure indication gauge 124 displays the pressure that is supplied to one or more CABA 198 for filling.

Also visible in FIG. 2 are the five bank isolation valves 126; one for each of the five banks 164-172. The bank isolation valves 126 may be operated to open or shut off the relevant banks 164-172. Bank isolation valves 126 may be lockable to secure in them at a setting. This opening and shutting off may be for filling or for safe maintenance and transport.

In the embodiment shown, the five bank isolation valves 126 are ball valves.

Fill panel 120 also comprises pressure gauges 128-136 (first pressure gauge 128 for bank 1, 164; second pressure gauge 130 for bank 2, 166; third pressure gauge 132 for bank 3, 168; fourth pressure gauge 134 for bank 4, 170; and fifth pressure gauge 136 for bank 5, 172); one pressure gauge for each of banks 1-5, 164-172. The provision of pressure gauges 128-136 makes it quick and easy to observe the pressure in each bank 164-172.

In the embodiment shown, pressure gauges 128-136 are Wika 63 mm diameter, S/S case, 0-400 bar, liquid filled gauges.

As best seen in FIG. 2, fill panel 120 also comprises five CABA fill attachments 137, which may be used to fill a corresponding CABA 198. Each CABA fill attachment 137 comprises a lever 139, a fill valve 140, fill hose 138 and a high pressure quick release coupling 141 for connecting to a CABA 198 (the components are only labeled on the left hand side fill attachment 137). Advantageously, quick release coupling 141 allows connection and disconnection to a CABA 198 whether under pressure or not. In one embodiment, the quick release coupling is a Normally Closed (NC) FD 17 quick release fill adapter.

Fill valves 140 may comprise beer tap valves which are self vented so when a user closes the valve 140, the air in hose 138 will be released automatically.

When fill valves 140 are beer tap valves and they are combined with the quick release coupling 141, this combination allows a user to connect and disconnect under pressure. The venting provided by the beer tap valves makes the disconnecting easier and makes servicing easier and safer.

Provision of the five CABA fill attachments 137 allows filling of five CABA 198 (not shown) simultaneously.

FIG. 3 shows a rear view of fill panel 120. The main shut off valve 122, fill pressure indication gauge 124 and pressure gauges 128-136 can all be seen. The rear view allows pressure regulator 142, orifice 144 and four sequence valves 146-152 to be seen.

Advantageously, orifice 144 restricts the flow and may create a delay so sequence valves 146-152 can sense the pressure.

In the embodiment shown, the regulator 142 is a single stage self venting brass standard flow pressure regulator made by Aquatech California USA.

The four sequence valves 146-152 control whether the filling of a CABA (198) is from bank 1, 164, bank 2, 166, bank 3, 168, bank 4, 170 or bank 5, 172. The sequence valves 146-152 control switching between banks 1-5, 164-172, i.e. the first sequence valve 146 controls switching between bank 1, 164 and bank 2, 166; the second sequence valve 148 controls switching between bank 2, 166 and bank 3, 168; the third sequence valve 150 controls switching between bank 3, 168 and bank 4, 170; and the fourth sequence valve controls switching between bank 4, 170 and bank 5, 172.

Each of the four sequence valves 146-152 may comprise a sequence valve lock 157 (not shown) to hold the sequence valve 146-152 in position. The sequence valve lock 157 is of significant advantage because it allows the positioning, e.g. fully open, partially open or closed, of a sequence valve 146-152 to be secured into position which prevents accidental adjustment during transport or use and protects sequence valves 146-152 against vibrations.

Lock 157 may be a locknut. In the embodiment shown, sequence valve lock 157 comprises a brass made thin nut 158 which is adjustable along a thread 159 (not shown).

Figure 4:
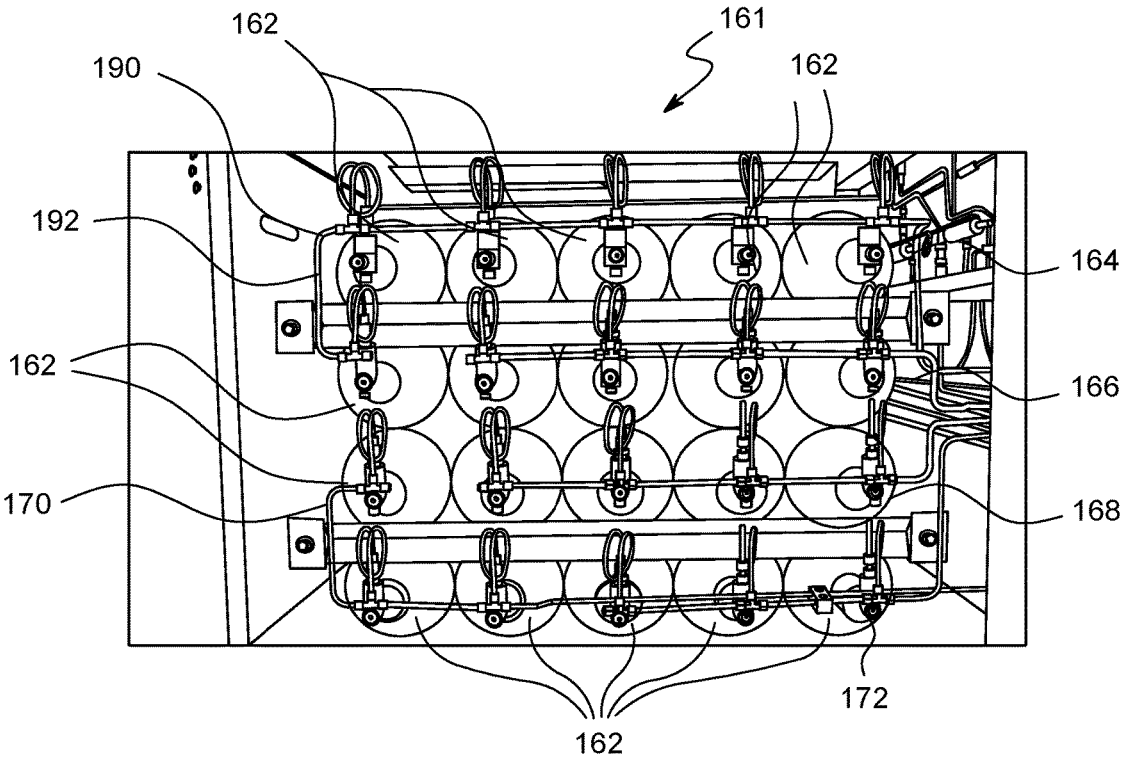
FIG. 4 is a view of a cascade bank system and part of a manifold according to one embodiment of the invention.

The cascade bank system 160 which is illustrated in FIG. 4, comprises 20 cylinders 162 connected with pipe 192 to manifold 190. In the present embodiment, each cylinder 162 comprises a 50 liter, high pressure cylinder with a nominal working pressure of 350 bar. A skilled person may use other suitable cylinders. As is appreciated by the skilled person only these particular cylinders have all the necessary certifications for use in Australia. For correct operation, the valves (not shown) of all 20 cylinders 162 should be fully opened.

For compact packing, cylinders 162 are arranged in a 4 row×5 column matrix, however, another suitable matrix may be used.

In a further surprising result, through diligent study the present inventors have discovered that efficiency and number of CABAs filled can be further increased by arranging cylinders 162 into the following structure:

bank 1, 164 six cylinders 162;
bank 2, 166 four cylinders 162;
bank 3, 168 four cylinders 162;
bank 4, 170 three cylinders 162; and
bank 5, 172 three cylinders 162.

Efficient arrangements are shown in Table 1 below.

TABLE 1

| Efficient arrangements: Number of cylinders | | | | |
|---|---|---|---|---|
| First Bank | Second Bank | Third Bank | Fourth Bank | Fifth Bank |
| 6 | 4 | 4 | 3 | 3 |
| 5 | 4 | 4 | 4 | 3 |
| 5 | 4 | 5 | 3 | 3 |
| 5 | 5 | 3 | 4 | 3 |
| 5 | 5 | 4 | 3 | 3 |
| 5 | 5 | 4 | 4 | 2 |
| 4 | 4 | 4 | 4 | 4 |
| 4 | 4 | 5 | 4 | 3 |
| 4 | 5 | 4 | 4 | 3 |
| 4 | 5 | 5 | 3 | 3 |
| 7 | 3 | 4 | 3 | 3 |
| 7 | 4 | 3 | 3 | 3 |
| 7 | 4 | 3 | 4 | 2 |
| 7 | 4 | 4 | 3 | 2 |
| 6 | 3 | 3 | 4 | 4 |
| 6 | 3 | 4 | 3 | 4 |
| 6 | 3 | 4 | 4 | 3 |
| 6 | 3 | 5 | 3 | 3 |
| 6 | 3 | 5 | 4 | 2 |
| 6 | 4 | 3 | 3 | 4 |
| 6 | 4 | 3 | 4 | 3 |
| 6 | 4 | 3 | 5 | 2 |
| 6 | 4 | 4 | 4 | 2 |
| 6 | 4 | 5 | 2 | 3 |
| 6 | 4 | 5 | 3 | 2 |
| 6 | 5 | 3 | 3 | 3 |
| 6 | 5 | 3 | 4 | 2 |
| 6 | 5 | 4 | 2 | 3 |
| 6 | 5 | 4 | 3 | 2 |
| 6 | 6 | 3 | 3 | 2 |

This surprising result is of great advantage and significantly increases the efficiency of safety provision in dangerous sites such as underground mines by allowing faster filling and a greater number of CABA fills.

A further advantage of system 160 is that by using the available air volume and pressure much more efficiently a reduced number of cylinders 162 is required for the same CABA fills which lowers the weight and reduces the size of filling station 100.

Figure 5:
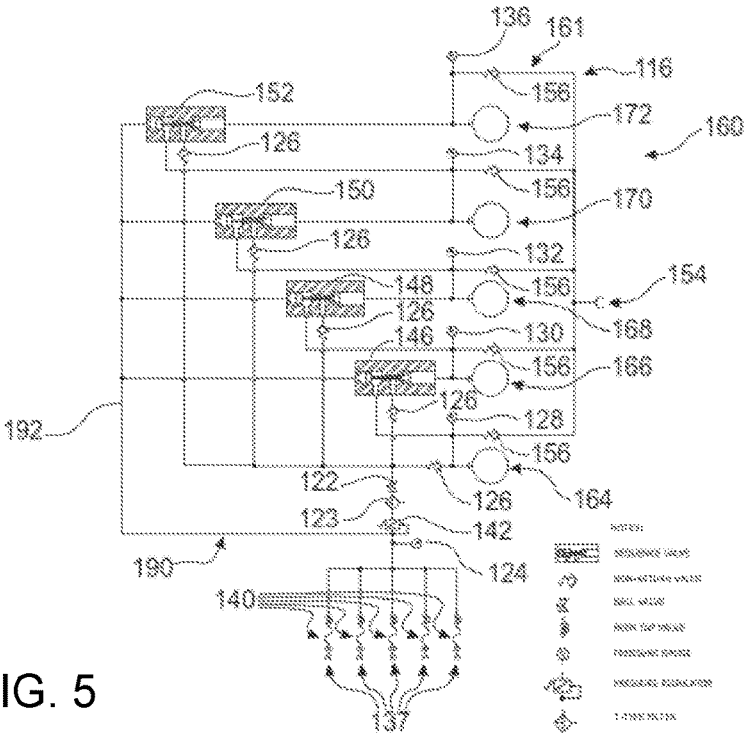
FIG. 5 is a schematic diagram showing one embodiment of the filling station of the invention.

A schematic diagram of the pneumatic circuit 116 comprised in filling station 100 is shown in FIG. 5. The relative position of banks 1-5, 164-172 and sequence valves 146-152 is shown; which illustrates that by locating first sequence valve 146 between the first bank 164 and the second bank 166, switching between these two banks 164 and 166 is accomplished. Similarly, by locating second sequence valve 148 between second bank 166 and third bank 168, switching between bank 166 and 168 is accomplished; by locating third sequence valve 150 between third bank 168 and fourth bank 170, switching between these banks 168 and 170 is accomplished; and by locating fourth sequence valve 152 between fourth bank 170 and fifth bank 172, switching between these banks 170 and 172 is accomplished.

FIG. 5 also shows the relative location of pressure gauges 128-136 as adjacent to the respective bank 164-172.

Similarly, bank isolation valves 126 are shown in FIG. 5 to be adjacent respective bank 1-5 164-172.

A filter 123 is also shown located between main shut off valve 122 and pressure regulator 142 so that filter 123 is positioned before orifice and between main shut off valve 122 and pressure regulator 142. Filter 123 may be an electronic filter, in the embodiment shown the filter 123 is a T-type filter. Based on the teaching herein, a skilled person is readily able to select other suitable filters 123.

Another feature of filling station 100 is shown in FIG. 5, namely a recharging connection 154 which allows quick connection to a compressor 194 (not shown) or other recharging device (not shown) for recharging filling station 100. The quick and efficient recharging of filling station 100 is another significant contribution by the present inventors and will be explained in more detail below.

Another feature of filling station 100 is provision of non-return valves 156 separating each bank 164-172 from compressor connection 154. In the embodiment shown the non-return valves 156 are Swagelok, stainless steel brand poppet check valves. Based on the teaching herein, a skilled person is readily able to select other suitable valves.

The working principal behind the five stage cascade bank system 160 of the present invention is illustrated in FIG. 6. Five CABAs 198 are shown attached to filling station 100. Sequence valves 146-152 compare the pressure in CABA 198 with the pressure in the banks 164-172 and open a highest pressure bank partition. Under normal circumstances, i.e. when cylinder store 161 is full or substantially full, this will be bank 1, 164, followed in sequence by bank 2, 166, bank 3, 168, bank 4, 170 and bank 5, 172.

Further detail on the switching process is that sequence valves 146-152 are connected to manifold 190 from which the discharge pressure of the regulator 142 (which is similar to CABA pressure), as limited by regulator 142, is detected and which should be the nominal fill pressure desired for filling a CABA 198 and the supply pressure of the applicable bank 164-172 (i.e. as described above first sequence valve 146 controls switching between first bank 164 and second bank 166).

In the embodiment shown, pressure is detected on one side of a chamber divided by a piston type arrangement in sequence valve 146-152. The magnitude of the manifold pressure is enhanced by a spring so the pressures equalizes for example, at 250 bar pilot pressure and 280 bar supply pressure. When this point is exceeded the relevant sequence valve 146-152 opens to use the next bank 164-172. The sequencing controls by sequence valves 146-152 controls the switching in cascade bank system 160 to allow more air to flow from the previous bank (e.g. bank 1, 164, when switching is controlled by first sequence valve 146 from bank 1, 164 to bank 2, 166) because the pressure is lower.

In one embodiment the pressure regulator 142 is set to 300 bar and ensures that the CABA 198 is not overfilled.

When the pressure in the starting bank (when cylinder store 161 is full or substantially full, this will be bank 1, 164) is not sufficient, filling station 100 automatically switches to the bank 164-172 with the next highest pressure until 300 bar is shown fill pressure indication gauge 124.

Once the CABA 198 is connected to the CABA fill attachment 137, fill valves 140 can be opened and the fill process monitored on the pressure gauge(s) on the CABA 198. When 300 bar or the desired pressure is reached the self-venting or fill valve(s) 140 can be closed by operating lever(s) 139.

Figure 7:
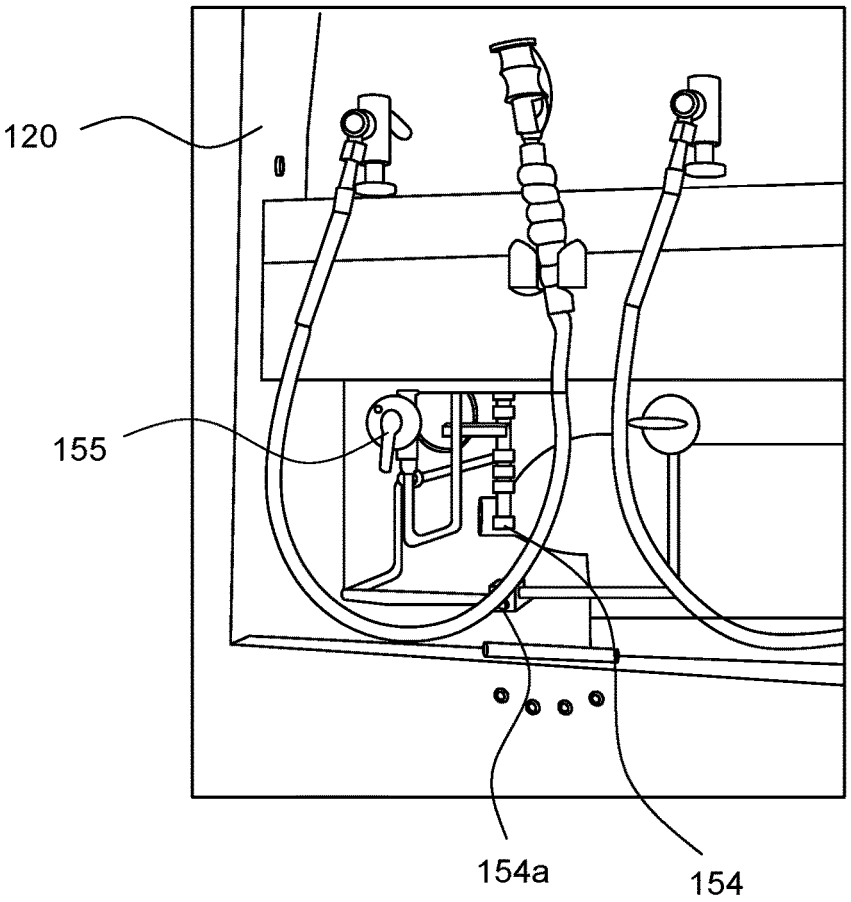
FIG. 7 is a view showing a section of a fill panel according to one embodiment of the invention.

As discussed above, filling station 100 comprises a recharging connection 154 for connection to a compressor 190 or other recharging device for recharging filling station 100. The location of recharging connection 154 comprised on fill panel 120 is shown in FIG. 7. In the embodiment shown recharging connection 154 comprises a shut-off valve 155 and a high pressure quick release coupling 154*a*.

Figure 8:
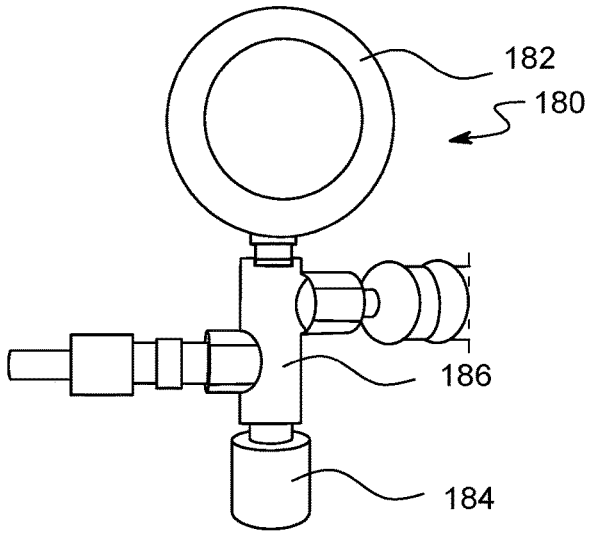
FIG. 8 is a front view showing a recharge adaptor according to one embodiment of the invention.

Connection of filling station 100 to compressor 190 or other recharging device may be performed using a recharge adaptor 180 like that shown in FIG. 8. Recharge adaptor 180 comprises a pressure gauge 182, a self-venting valve 184 and pipe assembly 186. Based on the teaching herein a skilled person is readily able to design or select other suitable recharge adaptors.

Once recharge adaptor 180 is connected to compressor connection 154 the self-venting valve 186 is opened and shut-off valve 122 is slowly opened. The compressor can then be started which fills filling station 100 with switching off happening automatically when a filling pressure of up to 350 bar is reached. If all cylinder banks 164-172 are completely filled, fill pressure indication gauge 124 on the fill panel 120 will show a pressure of 350 bar. Compressor 190 may then be shut down and the recharge shut-off valve 155 and then the self-venting valve 184 closed. Finally, recharge adaptor 180 can be disconnected from compressor connection 154.

A suitable compressor 190 is able to deliver 350 bar and supply breathing air according to AS/NS 1715. Suitable compressors are found in the BAUER Verticus V range with a SECURUS air filtration system. Based on the teaching herein a skilled person is readily able to select other suitable compressors 190.

The present inventors have also provided an alternative way of recharging a filling station such as filling station 100 to using a compressor 190. The advantages of this development by the inventors will become apparent below.

Figure 10:
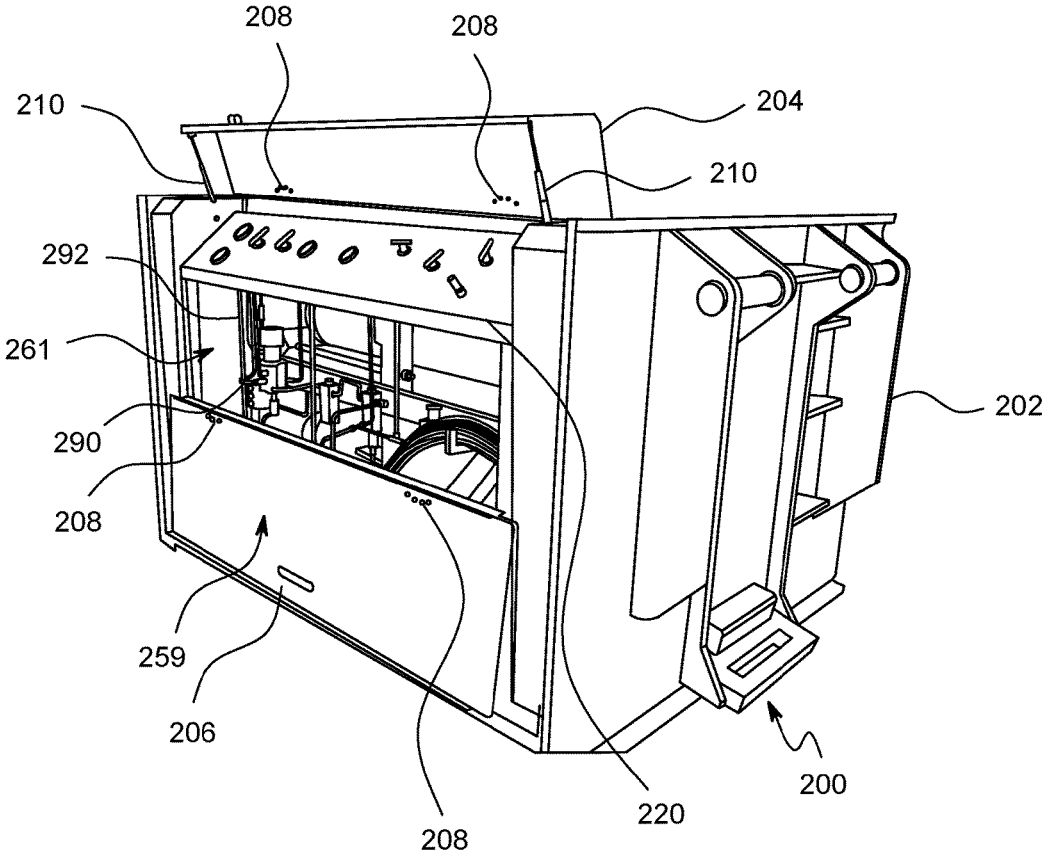
FIG. 10 is a front perspective view of one embodiment of recharging device according to the invention.

FIG. 10 shows a front view of one embodiment of a recharging device 200 according to the invention. Recharging device 200 also comprises a cradle 202 comprising a top hatch 204, a bottom hatch 206, hinges 208, support struts 210 and side door 212 (side door not shown in FIG. 10).

Cradle 202 is identical to cradle 102 and fully encloses recharging device 200 and is also in the form of a cradle that has retaining brackets that enables forklift access from three or four sides. Like cradle 102, cradle 202 may comprise high visibility indicators such as, bright paint and/or reflective decals and a quick detachment system. The material and dimensions of cradle 202 are as described for cradle 102.

Also shown in FIG. 10 are the recharging device control panel 220, manifold 290, pipe 292 and the location of pump 259 and cylinder store 261.

Figure 11A:
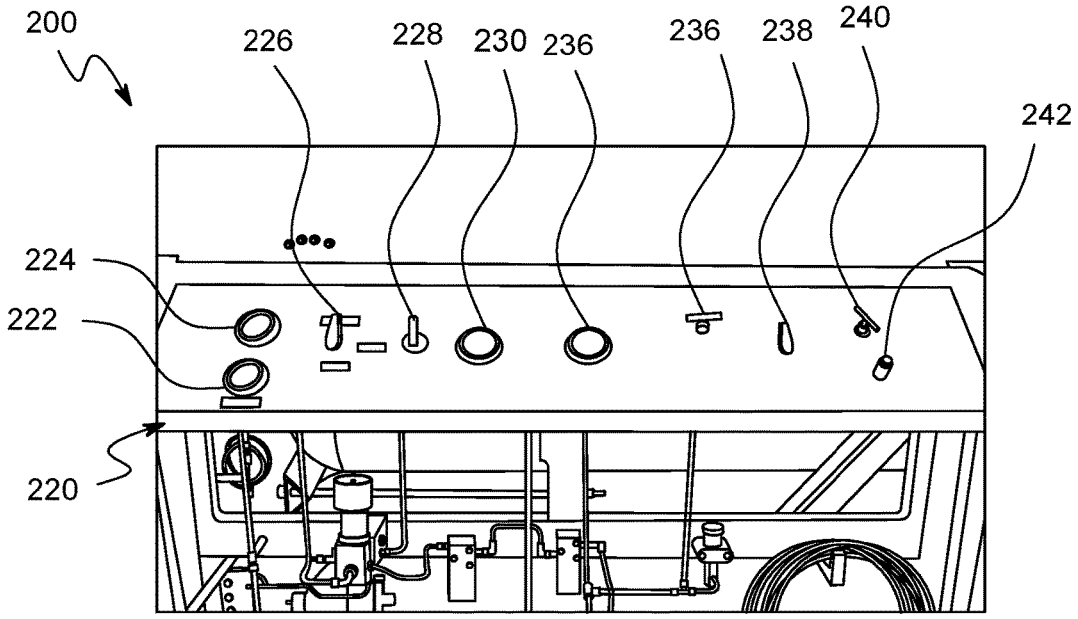
FIG. 11A is a front view of one embodiment of a recharging device control panel according to the invention.

FIG. 11A shows control panel 220 in more detail, from which is visible, drive pressure gauge 222, a drive bank pressure gauge 224, a drive isolation valve 226, a drive vent valve 228, an air supply pressure gauge 230, an air discharge pressure gauge 234, an upstream vent valve 236, an air discharge isolation switch 238, a downstream vent valve 240 and an air outlet 242.

Figure 11B:
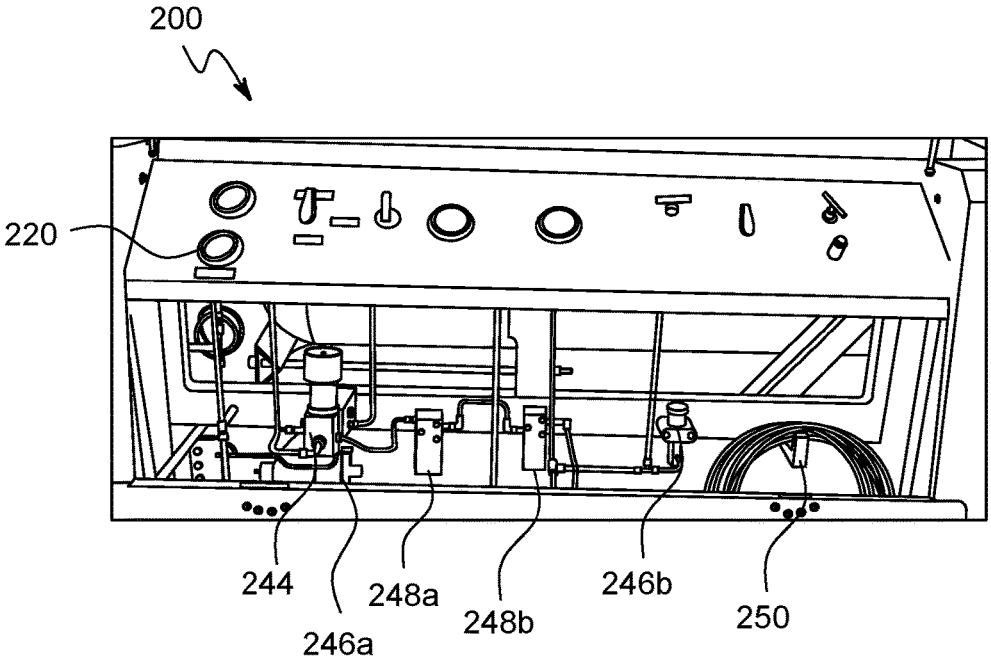
FIG. 11B is another front view of the one embodiment of a recharging device control panel according to the invention.

FIG. 11B shows a lower view of control panel 220, from which is visible, pressure regulator 244, safety valves 246*a* and 246*b*, pilot valves 248*a* and 248*b*, and fill hose assembly 250.

In a preferred embodiment, the regulator 244 may be set to less than 8 bar to ensure the drive line of the pump 259 is not over pressurized.

Figure 12:
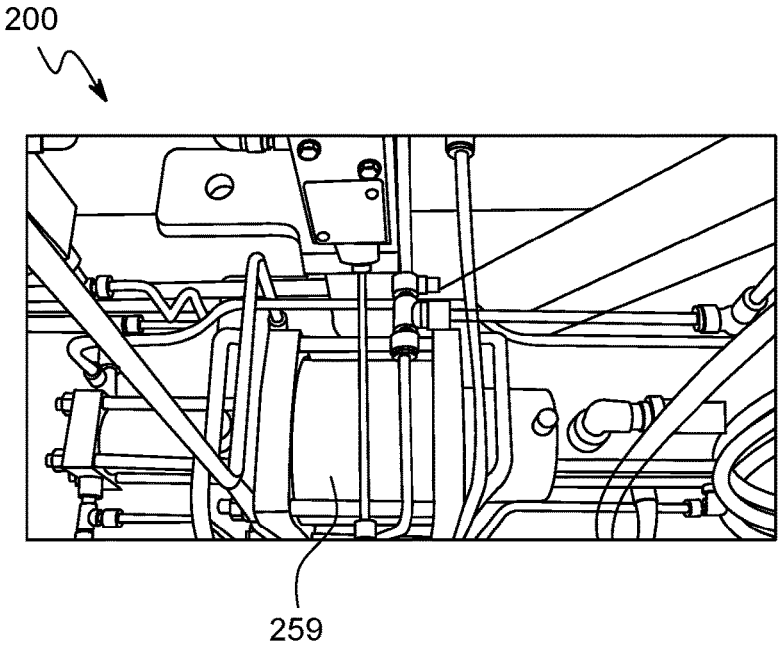
FIG. 12 is a view of one embodiment of a pump according to the invention.

FIG. 12 shows pump 259 comprised in cradle 202. Pump 259 uses drive pressure to increase the supply pressure and thereby acts as a booster pump. Of great advantage, in the embodiment shown, pump 259 and recharging device 200 do not require a power supply to operate.

Figure 13:
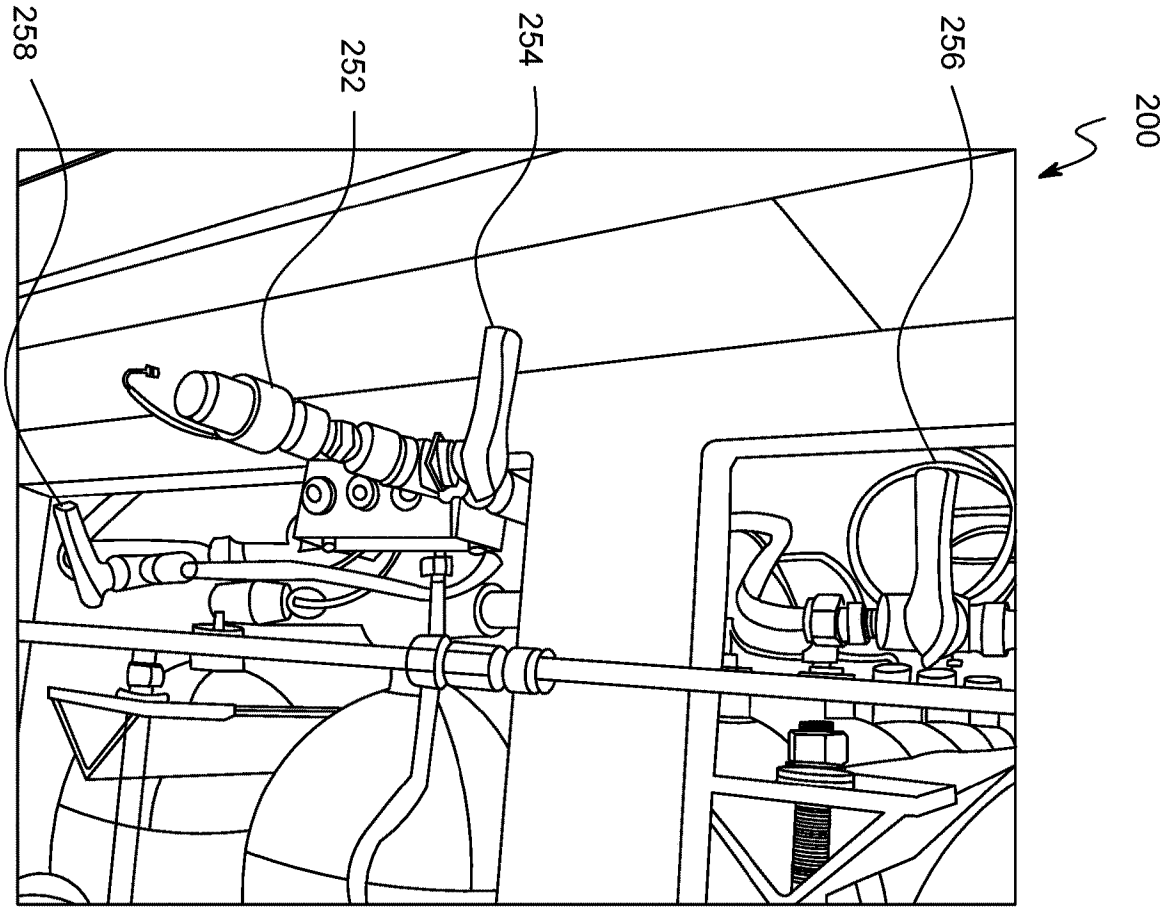
FIG. 13 is a view of one embodiment of the recharging coupling.

FIG. 13 shows the left hand side of the lower section of control panel 220 which shows quick coupling 252, air charge inlet valve 254, air supply control valve 256 and drive supply control valve 258.

Figure 14:
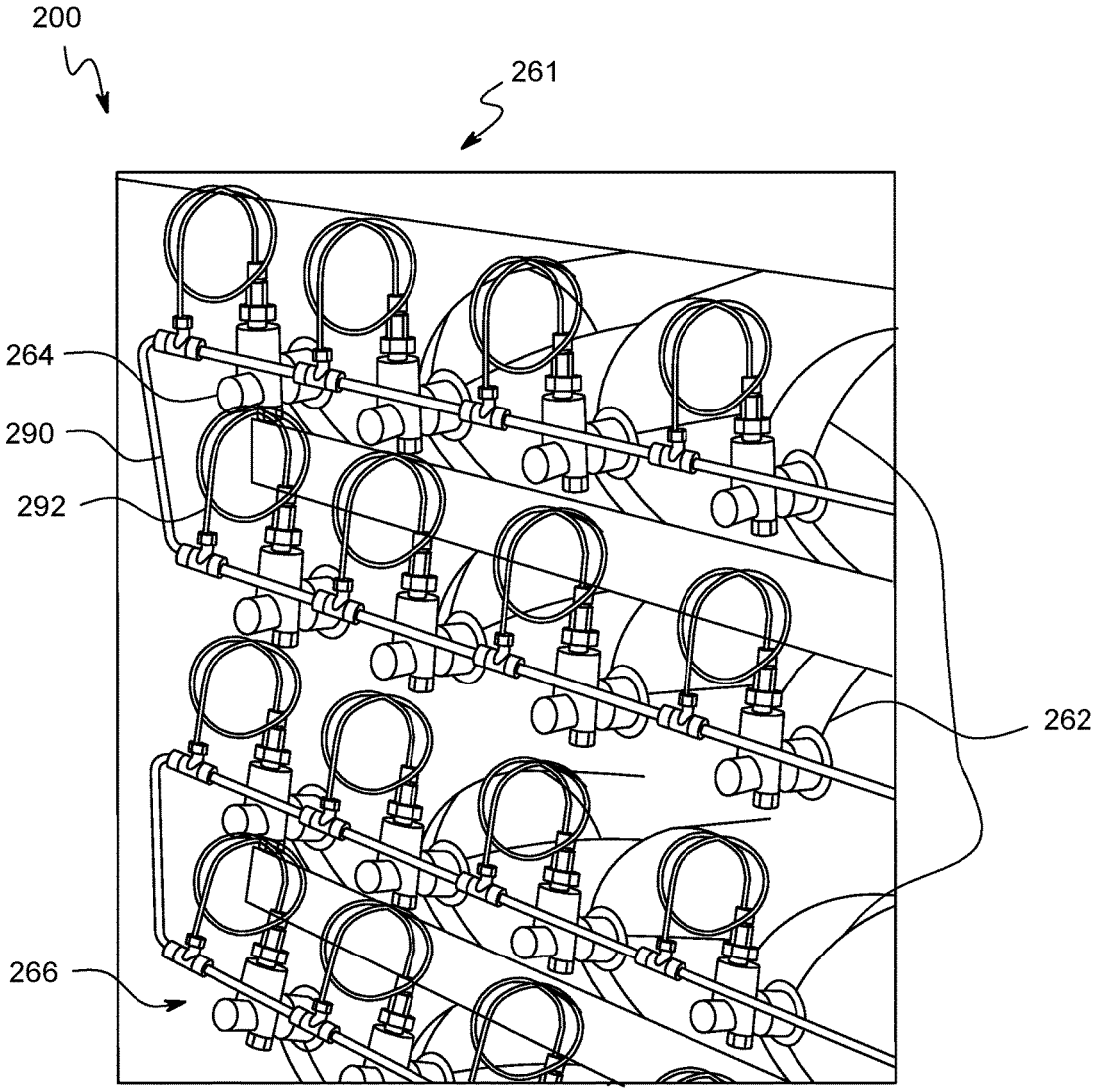
FIG. 14 is a view of one embodiment of the cylinder store of the recharging device.

FIG. 14 shows a side view of recharging device 200 from which is visible the cylinder store 261 comprising twenty cylinders 262 that are divided into two banks, first bank 266 and second bank 264.

In the embodiment shown, the first bank 266 is a drive bank used to at least partially power the recharging, and second bank 264 is a supply bank used to supply compressed air for transfer to and recharging for example filling station 100.

In another embodiment cylinder store 261 comprises a sole bank of cylinders 262.

Figure 15:
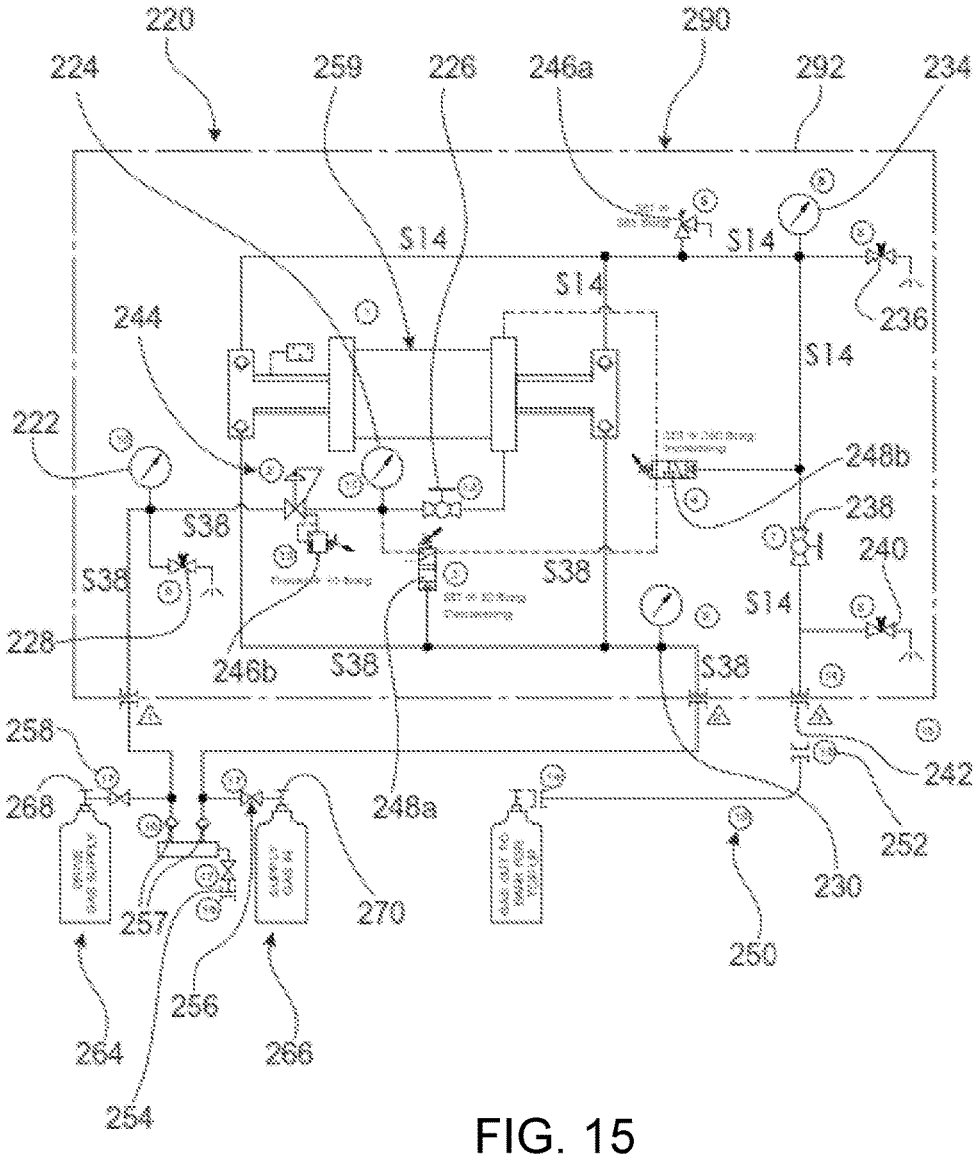
FIG. 15 is a schematic diagram showing one embodiment of recharging device pneumatic circuit according to the invention.

Each bank 264, 266 has an associated bank shut off valve, first bank shut off valve 268 and second bank shut off valve 270 which are shown on FIG. 15. Valves 268, 270 may be ball valves.

FIG. 15 is a schematic diagram of the pneumatic circuit comprised in recharging device 200. The relative position of the components comprised is shown.

Also shown in FIG. 15 are the location of check valves 257, between each bank 264, 266 and air charge inlet valve 254.

Control panel 220 is used to control recharging of one or more breathing apparatus filling station, such as filling station 100, with air stored in cylinder store 161.

Similar to the arrangement in filling station 100, manifold 290 connects the fill panel 220 and pump 259 to the cylinder store 261.

To operate recharging device 200, drive isolation valve 226, air discharge isolation valve 238, downstream vent valve 240 and drive vent valve 228 must be shut. The drive supply isolation valve and air supply isolation valve may then be opened slowly.

The fill hose assembly 250 may then be connected to filling station 100 at the recharging connection 154 and shut-off valve 155 opened along with the bank isolation valves 126.

The air discharge isolation valve 238 may then be slowly opened and the air allowed to equalise between cylinder store 261 and cascade bank system 160.

The air discharge isolation valve 238 may then be opened slowly to allow pump 259 to begin pumping.

To disconnect, the drive isolation valve 226 is shut off and the pressure regulator 244 is backed off completely. Valve 155 and air discharge isolation valve 238 may then be shut along with drive isolation valve 226 and air discharge isolation valve 238. To vent, downstream vent valve 240 may then be opened.

Before disconnecting the filling station 100, the upstream vent valve 236 may be opened to depressurise.

The recharging device 200 may be recharged with a compressor 194 using recharge adaptor 180. The procedure is similar to that outlined above with respect to filling station 100.

Of significant advantage, pump 259 at least partially powers the recharging.

The invention also provides a method of recharging filling station 100 including the step of connecting recharging device 200 and recharging the filling station with compressed air comprised in the cylinder store 261 powered at least in part by the pump 259.

The recharging of filling station 100 illustrates another significant advantage of the present invention which is that a separate bank of cylinders is not required to fill cylinder store 161.

The filling station and recharging device 200 may be combined to form a filling station assembly.

The invention also provides a method for filling a filling station including the step of connecting a compressor to a filling station through a compressor connection comprised in the fill station. The method also includes operating the compressor so that a cylinder store comprised in the fill station is filled or partially filled.

According to the method of the invention, the step of connecting the compressor to the filling station may include connecting through a recharge adaptor 180.

The invention further provides a compressed air breathing apparatus filled by the filling station 100, the filling station assembly or the method described herein.

Another advantage of the filling station 100 is that no electrical components are used. This means filling station 100 is suitable for use in a large number of environments including those where electrical components are a safety hazard.

The maximum operating pressure of filling station 100 is 350 bar and the filling pressure is adjustable at 200 or 300 bar depending on the CABA pressure. The filling time for filling station 100 to fill a 9 liter CABA to 300 bar is 25-95 seconds. Surprisingly, filling station 100 can accomplish up to 70 fills of 9 liter CABA from 60 bar (safety whistle point) to 300 bar without recharging.

These enhanced capabilities of filling station 100 are of significant advantage and may be used in different ways to accommodate a user's requirements. In general, the advanced capabilities of filling station 100 can be used to fill quicker or more CABA sets or more and quicker.

Depending on the set up of filling station 100, more than a 50% increase on standard CABA set fills may be achieved over conventional filling stations. It is understood that to achieve such a high number of fills, the minimum allowed storage pressure should be as close as practical possible to the maximal operational pressure (350 bar).

Another advantage is that the individual fill time of a CABA with filling station 100 is shorter than compared with compared with convention filling stations.

The following non-limiting examples illustrate the filling station 100 and methods of the invention. These examples should not be construed as limiting: the examples are included for the purposes of illustration only. The filling station 100 discussed in the Examples will be understood to represent an exemplification of the invention.

EXAMPLES

Test Results

Compare Simulation and Experiment:

Computational simulations were performed to calculate the number of CABA fills achievable by filling station 100. The results of the simulation and experimental tests are shown in Table 1.

TABLE 1

Comparison of simulation of filling station 100 and experimental values

| | Simulation | Experiment | Accuracy | Deviation |
|---|---|---|---|---|
| No. of fills | 70 | 65 | %92.3 | 7.7 |

Figure 9:
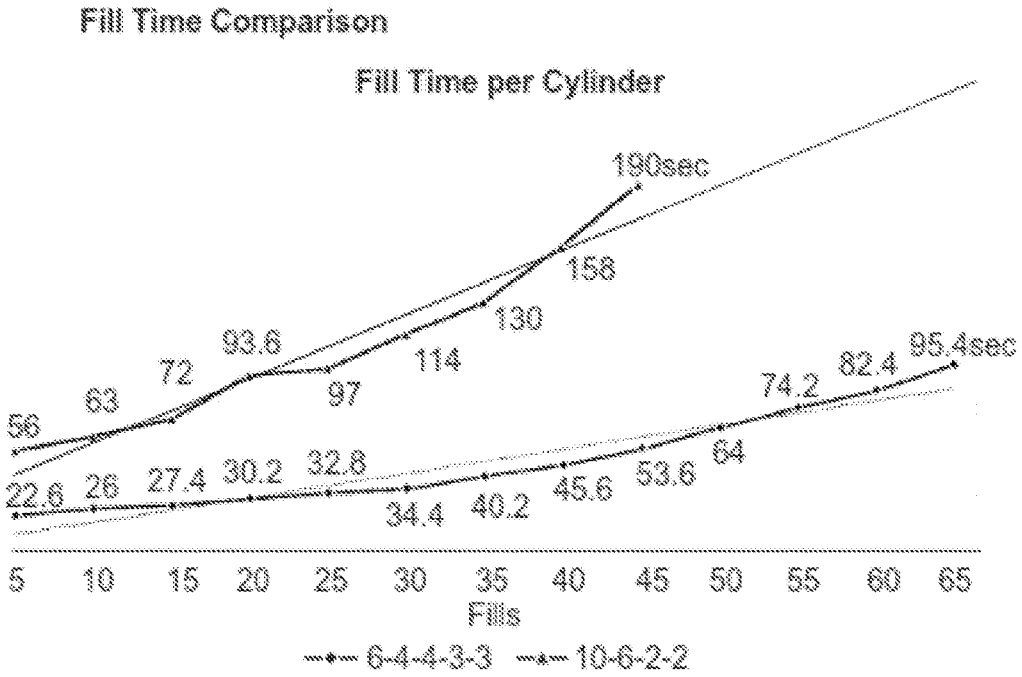
FIG. 9 is a line graph showing the fill time comparison of the present invention compared to a conventional filling station.

Optimization of Filling Station 100:

Experimental studies were performed to compare filling station 100 with a conventional filling station (Drager C40). As shown in Table 2, filling station 100 had a much greater number of CABA fills and far better performance in minimum fill time, maximum fill time and average fill time. A graph of these results is shown in FIG. 9.

TABLE 2

Comparison of Filling Station 100 with conventional filling station

| | Conventional filling station | Filling Station 100 | Optimization |
|---|---|---|---|
| No. of fills | 40-42 | 65 | %54.76 |
| Min fill time (Sec) | 52 | 22.6 | %56.54 |
| Max fill time (Sec) | 190 @40 | 95.4 @65 | %49.79 |
| Average fill time (Sec) | 108.18 | 48.36 | %55.29 |

Throughout the specification, the aim has been to describe the preferred embodiments of the invention without limiting the invention to any one embodiment or specific collection of features. It will therefore be appreciated by those of skill in the art that, in light of the instant disclosure, various modifications and changes can be made in the particular embodiments exemplified without departing from the scope of the present invention.

All computer programs, algorithms, patent and scientific literature referred to herein is incorporated herein by reference.

While specific embodiments of the invention have been shown and described in detail to illustrate the application of the principles of the invention, it will be understood that the invention may be embodied otherwise without departing from such principles.

The invention claimed is:

1. A filling station for a breathing apparatus, the filling station comprising:

a cradle comprising a fill panel, a pneumatic circuit, a manifold and a cascade bank system, wherein:

the fill panel comprises four sequence valves for controlling filling of one or more compressed air breathing apparatus with air stored in the cascade bank system;

the pneumatic circuit and the manifold connects the fill panel to the cascade bank system;

the cascade bank system comprises a cylinder store comprising five banks; and the filling station operates without a need of any electronic components.

2. The filling station of claim 1, wherein one or more of the sequence valves comprise a lock to secure the sequence valve.

3. The filling station of claim 2 wherein the lock comprises a locknut.

4. The filling station of claim 1, wherein the five banks comprise a first bank comprising six cylinders, a second bank comprising four cylinders, a third bank comprising four cylinders, a fourth bank comprising three cylinders and a fifth bank comprising three cylinders.

5. The filling station of claim 1, wherein the five banks comprise a configuration selected from the following:

| Number of cylinders | | | | |
|---|---|---|---|---|
| First Bank | Second Bank | Third Bank | Fourth Bank | Fifth Bank |
| 6 | 4 | 4 | 3 | 3 |
| 5 | 4 | 4 | 4 | 3 |
| 5 | 4 | 5 | 3 | 3 |
| 5 | 5 | 3 | 4 | 3 |
| 5 | 5 | 4 | 3 | 3 |
| 5 | 5 | 4 | 4 | 2 |
| 4 | 4 | 4 | 4 | 4 |
| 4 | 4 | 5 | 4 | 3 |
| 4 | 5 | 4 | 4 | 3 |
| 4 | 5 | 5 | 3 | 3 |
| 7 | 3 | 4 | 3 | 3 |
| 7 | 4 | 3 | 3 | 3 |
| 7 | 4 | 3 | 4 | 2 |
| 7 | 4 | 4 | 3 | 2 |
| 6 | 3 | 3 | 4 | 4 |
| 6 | 3 | 4 | 3 | 4 |
| 6 | 3 | 4 | 4 | 3 |
| 6 | 3 | 5 | 3 | 3 |
| 6 | 3 | 5 | 4 | 2 |
| 6 | 4 | 3 | 3 | 4 |
| 6 | 4 | 3 | 4 | 3 |
| 6 | 4 | 3 | 5 | 2 |
| 6 | 4 | 4 | 4 | 2 |
| 6 | 4 | 5 | 2 | 3 |
| 6 | 4 | 5 | 3 | 2 |
| 6 | 5 | 3 | 3 | 3 |
| 6 | 5 | 3 | 4 | 2 |
| 6 | 5 | 4 | 2 | 3 |
| 6 | 5 | 4 | 3 | 2 |
| 6 | 6 | 3 | 3 | 2. |

6. A method of filling a compressed air breathing apparatus, the method comprising the steps of:

providing a filling station comprising a cradle comprising a fill panel, a pneumatic circuit, a manifold and a cascade bank system, wherein the fill panel comprises four sequence valves for controlling filling of one or more compressed air breathing apparatus with air stored in the cascade bank system, the pneumatic circuit and the manifold connects the fill panel to the cascade bank system and the cascade bank system comprises a cylinder store comprising five banks, wherein the filling station operates without a need of any electronic components; and connecting the compressed air breathing apparatus to the filling station.

7. The method of claim 6, wherein two or more compressed air breathing apparatus are filled simultaneously.

8. The method of claim 6 further comprising using a lock to secure one or more of the four sequence valves.

9. A method of filling a compressed air breathing apparatus, the method comprising the steps of:

connecting the compressed air breathing apparatus to a filling station; and controlling the filling from air stored in a cascade bank system, the cascade bank system comprising a cylinder store comprising five banks and four sequence valves, the four sequence valves being connected to the cascade bank system by a manifold and a pneumatic circuit, wherein the filling is operated without a need of any electronic components.

10. A filling station assembly comprising a filling station comprising a cradle comprising a fill panel, a pneumatic circuit, a manifold and a cascade bank system, wherein the fill panel comprises four sequence valves for controlling filling of one or more compressed air breathing apparatus with air stored in the cascade bank system, the pneumatic circuit and the manifold connects the fill panel to the cascade bank system and the cascade bank system comprises a cylinder store comprising five banks, wherein the filling station operates without a need of any electronic components; and a filling station recharging device comprising a cradle comprising a control panel, a manifold, a cylinder store and a pump, wherein the control panel comprises one or more valves for controlling recharging of one or more breathing apparatus filling station with air stored in the cylinder store, the pump and cylinder store at least partially powering the recharging.

11. The filling station of claim 1, wherein the manifold further comprises a recharging connection for connecting the filling station to a compressor or other recharging device to allow recharging the cylinder store.

12. The filling station of claim 1, wherein the fill panel comprises a main shut off valve which can be turned to either an on position or an off position to activate and deactivate the filling station.

13. The filling station of claim 1, wherein the fill panel comprises a pressure indication gauge which displays a pressure that is supplied to the one or more compressed air breathing apparatus for filling.

14. The filling station of claim 1, wherein the fill panel comprises five bank isolation valves which may be operated to open or shut off a respective bank of the five banks.

15. The filling station of claim 14, wherein each of the five bank isolation valves are lockable to be secured at a setting.

16. The filling station of claim 1, wherein the fill panel comprises a pressure regulator and orifice, the orifice restricting flow to create a delay so the four sequence valves can sense a pressure.

17. The method of claim 9, wherein the five banks comprise a configuration selected from the following:

| Number of cylinders | | | | |
|---|---|---|---|---|
| First Bank | Second Bank | Third Bank | Fourth Bank | Fifth Bank |
| 6 | 4 | 4 | 3 | 3 |
| 5 | 4 | 4 | 4 | 3 |
| 5 | 4 | 5 | 3 | 3 |
| 5 | 5 | 3 | 4 | 3 |
| 5 | 5 | 4 | 3 | 3 |
| 5 | 5 | 4 | 4 | 2 |
| 4 | 4 | 4 | 4 | 4 |
| 4 | 4 | 5 | 4 | 3 |
| 4 | 5 | 4 | 4 | 3 |
| 4 | 5 | 5 | 3 | 3 |
| 7 | 3 | 4 | 3 | 3 |
| 7 | 4 | 3 | 3 | 3 |
| 7 | 4 | 3 | 4 | 2 |
| 7 | 4 | 4 | 3 | 2 |
| 6 | 3 | 3 | 4 | 4 |
| 6 | 3 | 4 | 3 | 4 |
| 6 | 3 | 4 | 4 | 3 |

-continued

| Number of cylinders | | | | |
|---|---|---|---|---|
| First Bank | Second Bank | Third Bank | Fourth Bank | Fifth Bank |
| 6 | 3 | 5 | 3 | 3 |
| 6 | 3 | 5 | 4 | 2 |
| 6 | 4 | 3 | 3 | 4 |
| 6 | 4 | 3 | 4 | 3 |
| 6 | 4 | 3 | 5 | 2 |
| 6 | 4 | 4 | 4 | 2 |
| 6 | 4 | 5 | 2 | 3 |
| 6 | 4 | 5 | 3 | 2 |
| 6 | 5 | 3 | 3 | 3 |
| 6 | 5 | 3 | 4 | 2 |
| 6 | 5 | 4 | 2 | 3 |
| 6 | 5 | 4 | 3 | 2 |
| 6 | 6 | 3 | 3 | 2. |

18. The filling station assembly of claim 10, wherein the recharging device operates without a need of any electronic components.

* * * * *